United States Patent [19]

Elhaus

[11] Patent Number: 4,635,459

[45] Date of Patent: Jan. 13, 1987

[54] SYSTEM FOR CONTROLLING A PULLING ASSEMBLY

[76] Inventor: Friedrich W. Elhaus, Dorfstr. 21, 7761 Moos, Fed. Rep. of Germany

[21] Appl. No.: 720,966

[22] Filed: Apr. 8, 1985

[51] Int. Cl.[4] ..... B21C 35/02

[52] U.S. Cl. ..... 72/257

[58] Field of Search ..... 72/257

[56] References Cited

U.S. PATENT DOCUMENTS

| | | | |
|---|---|---|---|
| 3,537,286 | 11/1970 | Speilvogel et al. | 72/257 |
| 3,881,339 | 5/1975 | Mannell | 72/257 |
| 4,307,597 | 12/1981 | Elhaus et al. | 72/257 |
| 4,566,298 | 1/1986 | Elhaus . | |

FOREIGN PATENT DOCUMENTS

| | | | |
|---|---|---|---|
| 878626 | 6/1953 | Fed. Rep. of Germany . | |
| 1299589 | 6/1969 | Fed. Rep. of Germany | 72/257 |

*Primary Examiner*—Lowell A. Larson

*Attorney, Agent, or Firm*—Laubscher & Laubscher

[57] ABSTRACT

In a system for controlling a puller assembly (3) for withdrawing an extruded section as it exits from an extruder, in which the puller assembly (3) is moved in withdrawing direction by means of a drive mechanism (9), the actual speed with which the extruded section (1) is withdrawn is sensed by means of a tachometer (34) and is delivered to a speed controller (32) for controlling the speed of the drive mechanism (9) for the puller assembly. Optimum pulling force may be adjusted by providing follower means (11, 12) between the puller assembly (3) and the drive mechanism (9), said follower means being acted on by an actuator (15) for permitting relative movement between a drive member (8) and the puller assembly. The relative movement of a follower (11) is delivered via a displacement detector (30) to the speed controller (32) as a disturbance factor.

7 Claims, 3 Drawing Figures

$p_{max}$
$p_{min}$
F
a
m
b

SYSTEM FOR CONTROLLING A PULLING ASSEMBLY

SPECIFICATION

BRIEF DESCRIPTION OF THE PRIOR ART

The invention is directed to a system for controlling a puller assembly for withdrawing an extruded section as it exits from an extruder, in which the puller assembly is moved in withdrawing direction by means of a drive mechanism.

It has been known to control a puller assembly to a constant pulling force and to this end to measure the pulling force (as shown in the inventor's U.S. Pat. No. 4,566,298 of Jan. 28, 1986, and DE-OS 2,933,262). This is an effective solution for extrusion operations in which every fresh billet is initially pressed from a standstill condition, in other words during discontinuous operation. By virtue of the pull control it is ensured that the same withdrawing force or pull will always be exerted on the extruded section.

Two puller assemblies are required for continuous operation of an extruder. The speed of the respective pulling means to be moved in the operative position first has to be synchronized to the extrusion speed of the extruded section. Subsequently, the extruded section is taken over, i.e. a load change-over between the first and the second puller assembly takes place.

SUMMARY OF THE INVENTION

It is the object of the present invention to provide a system of the type described above, which permits synchronization of the puller assembly to the moving extruded section and take-over of the moving section by a similarly moving puller assembly. In order to solve this object it is provided in a system of the type described above that the actual speed at which the extruded section is moved is sensed by a speed sensing means and is delivered as set-point or reference input value to a speed control means for controlling the speed of a drive mechanism for driving said puller assembly.

By virtue of the invention, it is possible to achieve speed control of the puller assembly, in which the set-point value is formed by the actual speed of the extruded section and the actual value is formed by the respective speed, e.g. rotational speed, of the drive mechanism of the puller assembly. The actual speed of the extruded section, i.e. the set-point value, may for instance be picked up by a roller urged in frictional engagement with the extruded section. When at least two puller assemblies are employed, the set-point value may also be provided by the actual speed of the puller assembly which is still in engagement with the extruded section.

When the extruded section is withdrawn by a puller means, it is desirable to maintain an optimum pulling force so that the section will remain as straight as possible and dimensionally stable. Even slight differences between the speed of the extruded section and that of the puller assembly will, however, result in large variations of the pulling force so that the extruded section may be over-strained, the cross-sectional dimensions may be reduced and breaking may be caused. To prevent this, an important improvement of the invention provides that follower means influenced by the exerted pulling force is disposed between the puller assembly and its drive mechanism, wherein an actuator actuates said follower means so that it permits a relative movement between a drive member of said drive mechanism and the puller assembly, and that a displacement detector is provided through which said relative movement is delivered as disturbance factor to the speed control means.

The follower means acts like a so-called jockey roller for deflecting a rope or a sheet material or the like which is to be wound, wherein said jockey roller may have a force applied thereto that varies with the operating conditions to produce an initial tension in the rope or the like.

According to a preferred embodiment, the follower means comprises a follower which is movably guided in withdrawing direction on a truck of the puller assembly and which is influenced either in or parallel to the line of action of pull by said actuator, which may especially be a fluid cylinder.

In order to enable operation of the puller assembly with a selected pull, a further preferred embodiment of the invention provides that the actual pulling force is sensed by means of a pulling force sensor and is then delivered to a pulling force control means which produces a control signal for the actuator on the base of an adjustable pulling force reference input value.

The invention may be employed in all cases where a travelling section, which e.g. exits from an extruder outlet at the extrusion speed, is to be taken up by a puller assembly during operation, i.e. without stopping.

The invention may be advantageously employed particularly in continuous extrusion processes providing two puller assemblies which alternately act on the extruded section.

BRIEF DESCRIPTION OF THE DRAWINGS

Embodiments of the invention will be explained in detail below with reference to schematic drawings, in which.

DETAILED DESCRIPTION

Figure 1:
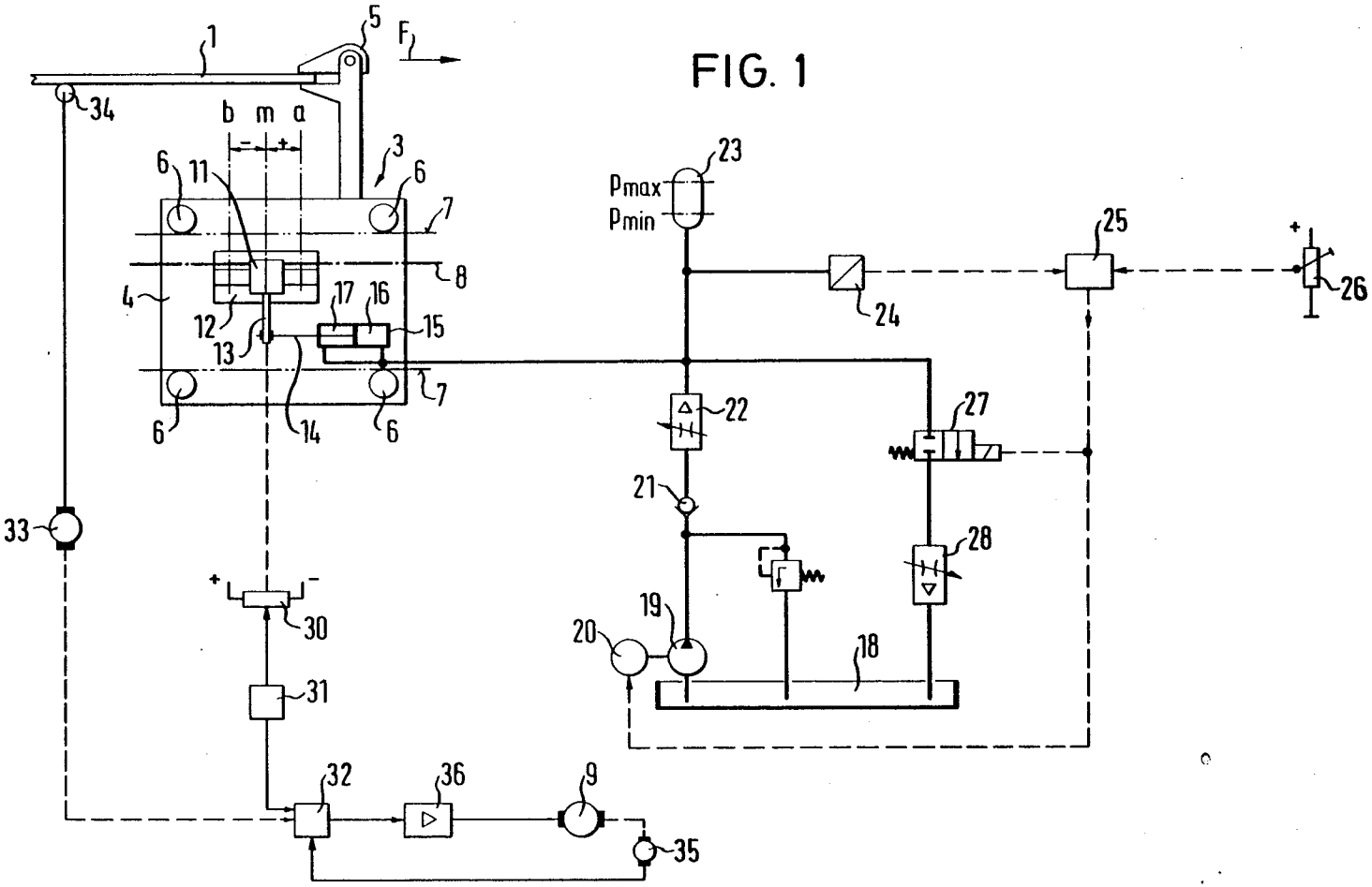
FIG. 1 is a first embodiment of an assembly according to the invention including the associated control circuit.
Figure 2:
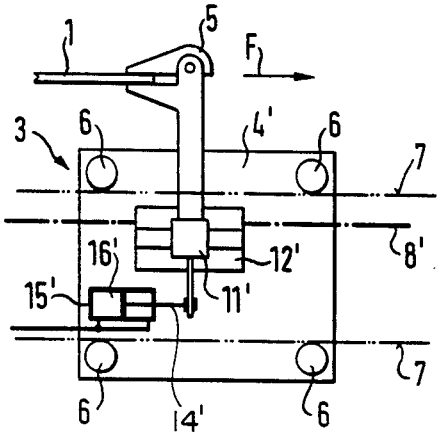
FIG. 2 is a second embodiment of the assembly according to the invention, in which the control circuit shown in FIG. 1 is employed but is not illustrated again.

The figures show an extruded section generally referenced 1, which exits from the outlet 2 (FIG. 3) of a continuously operating extruder. A puller assembly is generally indicated at 3 and comprises a truck 4 and a puller head 5. As shown in FIGS. 1 and 2, the truck 4 is movable via rollers 6 on guide rails 7 by means of an endless chain 8, which is adapted to be driven via a sprocket by a variable-speed d.c. motor 9. On the truck 4 there is mounted a guide means 12 oriented in the direction of puller movement for guiding a follower 11 which is movable along said guide means about a central position m between a position a of maximum excursion and a position b of minimum excursion. The follower 11 includes an arm 13 which extends transversely to the direction of movement of the follower and has the piston rod 14 of a hydraulic cylinder 15 pivotally mounted thereon. Pressure is applied to the pressure chambers 16, 17 of the hydraulic cylinder 15 through a pump 19 driven by a motor 20 via a check valve 21, a flow regulator 22 and a hydraulic accumulator 23 such that only a small force is released which corresponds to the product of piston rod area and pressure. A pressure pick-up 24 is branched off intermediate the flow regulator 22 and the accumulator 23 for delivering an actual value representative of the pulling force to a pulling force regulator 25, in which a comparison is performed between the actual value and a set-point value for the pressure and thus the pulling force, said set-point value being adjustable at a set-point device 26. The thus provided control deviation acts on the motor 20 driving the pump 19, so that the motor speed is maintained at a value corresponding to an optimum pulling force.

The control signal delivered by the pulling force regulator 25 is also delivered to a valve 27 which cooperates with a flow regulator 28 for controlling the return flow of hydraulic fluid from the cylinder 15 to the reservoir 18. This permits the load change-over between two puller assemblies alternately acting on the extruded section 1 after speed synchronization of the respective puller assembly that takes over the extruded section 1.

The movement of the follower 11 is feedforward-coupled as disturbance factor to a speed controller 32 via a displacement detector 30 having a measuring amplifier 31 connected to its output. The output from a tachogenerator 33 is delivered as set-point value to said speed controller 32, the tachogenerator being coupled to a roller 34 held in frictional engagement with the extruded section 1 for picking up the actual speed of the extruded section. The speed of the d.c. motor 9 for driving the chain 8 is likewise measured by a tachogenerator 35 and is supplied as actual value to the speed controller 32. The output signal of the speed controller is supplied via a power converter 36 to the d.c. motor 9 for controlling the rotary speed thereof.

In FIG. 2 the same reference numerals as in FIG. 1 have been used with primes added to certain modified components.

Whereas in the embodiment illustrated in FIG. 1 the chain 8 engages the follower 11, the chain engages the guide means 12', i.e. the truck 4', in the embodiment illustrated in FIG. 2. It is a further difference of the embodiment of FIG. 2 that the cylinder 15' is mounted to act in opposition to its operative direction illustrated in FIG. 1. In other words, in the embodiment shown in FIG. 1 the pressure applied to the pressure chamber 16 acts in opposition to the withdrawing direction indicated by the arrow F, i.e. the follower is displaced to the left relative to the truck, whereas in FIG. 2 the pressure in the pressure chamber 16' acts on the follower in pulling direction F. The embodiment according to FIG. 1 is advantageous when there are large speed variations of the drive mechanism 9. In this case the low-mass follower 11 may rapidly follow such speed variations by virtue of its being directly coupled to the drive mechanism via the chain 8. If it is desired, on the other hand, to compensate for fluctuations of the travelling speed of the extruded section, it will be more advantageous to couple the chain 8' to the high-mass part, viz. the truck 4', instead of to the follower 11, as illustrated in FIG. 2.

Figure 3:
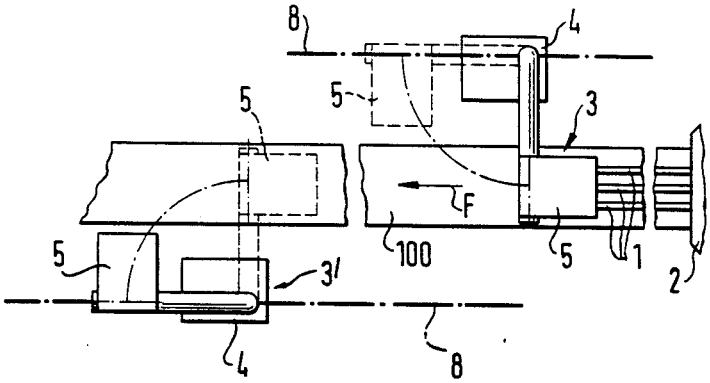
FIG. 3 is a system for continuously withdrawing an extruded section, in which two puller assemblies are employed.

FIG. 3 shows the use of the system according to FIG. 1 or FIG. 2 in an arrangement comprising two puller assemblies movable on either side of a run-out path and permitting continuous withdrawing of an extruded section 1 from the outlet 2 of an aluminium extruder. The extruded sections 1 are withdrawn by the puller assembly 3 illustrated on the right-hand side in FIG. 3 in the direction of the arrow F. When this puller assembly 3 releases the extruded section 1 and its head 5 is pivoted out of the run-out path 100 in the manner illustrated, the puller assembly 3' shown on the left-hand side in FIG. 3 should have taken over the extruded section. To this end speed synchronization of the left-hand puller assembly 3' with the extruded section 1 will be necessary. Such speed synchronization is performed by means of the control circuit of the kind described with reference to FIG. 1.

OPERATION

In the described system, at the commencement of the synchronizing phase the puller assembly 3 acts with a set pulling force on the extruded sections 1. The feedforward-coupling of the disturbance factor represented by the follower movement is cut off, and the puller assembly 3', which in the meantime had been returned (to the right in FIG. 3) to its ready-position "empty", commences the synchronizing movement to the left at "zero" pulling force. Due to hydraulic fluid discharge from the hydraulic accumulator 23, the minimum pressure $P_{min}$ is provided thereat which by virtue of the acceleration and frictional forces causes either the follower 11 (embodiment of FIG. 1) or the head 5 (embodiment of FIG. 2) to move to the one end position. During this synchronizing phase the speed of the puller assembly 3' is controlled exclusively in accordance with that of the other, still engaged puller assembly 3. When the puller assembly 3' has controlledly reached the speed of the puller assembly 3, load change-over will take place. By proper setting of the flow regulators 22, 28 it is possible to dimension the decreasing force of the puller assembly 3 and the increasing force of the puller assembly 3' such that the sum of the forces will always remain constant. Only when the force of the puller assembly 3' has reached the set pulling force value and the force of the puller assembly 3 has reached "zero", will the centre deviation of the follower 11 be feedforward-coupled to the control circuit as disturbance factor. During the withdrawing operation the command variable "speed of extruded section" will always be effective with respect to the engaged puller assembly.

I claim:

1. Apparatus for controlling the operation of a puller assembly (3) operable to withdraw an extruded section (1) from an extruder, comprising (a) drive means (8,9) for driving said puller assembly in a pulling direction;

(b) speed control means (32) for controlling the speed of operation of said drive means, thereby to control the speed of said puller assembly;

(c) speed sensing means (33) for supplying to said speed control means a reference input signal that is a function of the actual speed of the extruded section; and (d) means (30) for supplying to said speed control means a disturbance input signal that is a function of the exerted pulling force on the extruded section, said disturbance signal supplying means including (1) follower means (11,11') arranged intermediate said puller assembly and said drive means, said follower means being influenced by the exerted pulling force on the extruded section;

(2) actuator means (15, 15') acting on said follower means to effect relative displacement between said drive means and said puller assembly; and (3) displacement detector means (30) for generating said disturbance signal as a function of the relative displacement between said drive means and said puller assembly.

2. Apparatus as defined in claim 1, wherein said follower means comprises a follower member mounted for displacement on said puller assembly in a direction parallel with the direction of pull on said extruded section.

3. Apparatus as defined in claim 2, wherein said drive means includes a drive member (8) connected with said follower member, and further wherein said actuator means acts on said follower member in a direction opposite to the extruded section pulling direction.

4. Apparatus as defined in claim 2, wherein said drive means includes a drive member (8) connected with a truck portion (4) of said puller assembly, and further wherein said actuator means acts on said follower member in the same direction as the extruded section pulling direction.

5. Apparatus as defined in claim 2, and further wherein said disturbance signal supplying means includes pulling force control means (25) for supplying to said actuator means a control signal that is a result of a comparison between the actual pulling force (24) and an adjustable reference value (26).

6. Apparatus as defined in claim 5, wherein said disturbance signal supplying means further includes a hydraulic accumulator (23), a source (19) of pressure fluid; and circuit means including at least one flow regulator (22,28) connecting said source with said accumulator, said actuator means and the sensor means (24) producing the actual pulling force being also supplied by said circuit means, respectively.

7. A continuous extrusion method, which comprises the steps of providing a pair of the extrusion pulling devices of claim 1 on opposite sides of a run-out path (100) for the sections to be extruded, and alternately synchronizing the devices relative to an extruded section (1) to be withdrawn.

* * * * *